US008348741B1

(12) United States Patent
Nottke

(10) Patent No.: US 8,348,741 B1
(45) Date of Patent: Jan. 8, 2013

(54) THREE CARD VIDEO POKER

(76) Inventor: Timothy G. Nottke, Toledo, OH (US)

( * ) Notice: Subject to any disclaimer, the term of this patent is extended or adjusted under 35 U.S.C. 154(b) by 0 days.

(21) Appl. No.: 13/470,542

(22) Filed: May 14, 2012

Related U.S. Application Data

(63) Continuation-in-part of application No. 12/368,319, filed on Feb. 10, 2009, now Pat. No. 8,177,617.

(60) Provisional application No. 61/029,043, filed on Feb. 15, 2008.

(51) Int. Cl.
*A63F 9/24* (2006.01)

(52) U.S. Cl. ..... 463/13; 273/292

(58) Field of Classification Search ..... 463/13, 463/20, 25, 42; 273/292
See application file for complete search history.

(56) References Cited

U.S. PATENT DOCUMENTS

2002/0187823 A1* 12/2002 Khal ..... 463/13
2007/0152402 A1* 7/2007 Schmidt et al. ..... 273/292

* cited by examiner

*Primary Examiner* — Brook Kebede
(74) *Attorney, Agent, or Firm* — Donald K. Wedding

(57) ABSTRACT

A poker game which comprises generating a row-column grid or matrix of three cards by three cards, a total of nine cards, such that there are three horizontal rows of poker hands, three vertical columns of poker hands, and two diagonal poker hands, a total of eight poker hands. The nine cards and any replacement cards may be dealt or generated from a special or custom deck or a standard deck of 52 cards. Multiple standard 52 decks may be used.

12 Claims, 15 Drawing Sheets

THREE CARD VIDEO POKER

RELATED APPLICATIONS

This application is a continuation-in-part under 35 U.S.C. 120 of U.S. patent application Ser. No. 12/368,319 filed Feb. 10, 2009, to issue as U.S. Pat. No. 8,177,617, with a claim of priority under 35 U.S.C. 119(e) of U.S. Provisional Application Ser. No. 61/029,043 filed Feb. 15, 2008.

RELATED PRIOR ART

The following references disclose a video poker game wherein multiple hands are dealt per game for a single player: U.S. Pat. Nos. 6,098,985 (Moody), 6,474,645 (Tarantino), 6,511,068 (Sklansky et al.), 6,561,898 (Moody), 7,247,092 (Jarvis et al.), U.S. Patent Application Publication Nos. 2003/0038425 (Tarantino), 2004/0219970 (Tarantino), 2005/0026668 (Tarantino), and 2006/0194628 (Novellie), all incorporated herein by reference.

U.S. Pat. No. 8,002,623 (Resnick et al.) discloses a gaming system with multiple game types, and is incorporated herein by reference.

U.S. Patent Application Publication 2007/0155500 (Honour) discloses a multiple player video poker game, and is incorporated herein by reference.

The following references disclose an improved poker game: U.S. Pat. Nos. 7,137,628 (Moody), 7,222,856 (Dodge), 7,222,857 (Moody), 7,222,858 (Moody), and 7,874,901 (Kirkpatrick), all incorporated herein by reference.

The following references disclose a gaming device with cards that impact the outcome of the game: U.S. Pat. Nos. 6,857,957 (Marks et al.) and 6,991,538 (Cannon), both incorporated herein by reference.

The following prior art references disclose electronic or computerized gaming devices: U.S. Pat. Nos. 5,042,809 (Richardson), 6,248,016 (Walker et al.), 6,332,839 (Walker et al.), 7,022,016 (Wood et al.), 7,222,857 (Moody), and 7,247,091 (Moody). U.S. Design Pat. No. D395,463 (Scott et al.) and U.S. Pat. No. 6,201,532 (Tode et al.) disclose an electronic gaming device with a deck mounted touch screen, all incorporated herein by reference.

The following prior art references disclose a three card poker game where the player's hand is compared to a dealer hand: U.S. Pat. Nos. 6,698,759 (Webb et al.), 6,773,012 (French), 7,165,770 (Snow), and 7,264,243 (Yoseloff et al.), all incorporated herein by reference.

FIELD OF INVENTION

This invention relates to a three card poker game wherein a plurality of unique poker hands are generated for a player and a dealer, allowing a player to receive multiple payouts before and after the player's hands are compared to the dealer's hand.

SPECIFIC EMBODIMENTS OF THE INVENTION

In accordance with this invention, there is provided a poker game which comprises generating a row-column grid or grid of three cards by three cards, a total of nine cards, such that there are three horizontal rows of poker hands and three vertical columns of poker hands, a total of six poker hands. The dealer receives three cards face down.

This invention relates to a multiple handed video poker game wherein a single player is dealt nine cards face up from a deck of cards, for example, a standard 52 card deck. The cards are arranged in a grid of three rows and three columns, with three cards per row and three cards per column, a total of nine cards. The dealer receives three cards face down.

A hand is defined as any row of three cards or any column of three cards. The player may collect on any number of hands one to six.

A typical game comprises the following steps:

1. The player makes an ante bet and an optional pair plus bet equal to the ante bet.
2. The dealer or computer deals the cards face up in a three card by three card grid or matrix for the player and deals three dealer cards face down.
3. The player decides to bet or fold any of the six hands that were dealt to him/her. If the player decides to play a specific hand, then he/she must place an equal bet on the bet hand next to the ante bet. If the player decides to fold the hand, he/she surrenders the ante bet.
4. The dealer or computer reveals the dealer cards. The dealer needs a queen or better to qualify. If the dealer's hand does not have a queen, then the player will win even money on the ante bet and the play will be returned to the player. If the dealer's hand has a queen, then the player's hands will be compared to the dealer's hand, with the higher hand or hands winning according to a pre-determined pay scale.

An example of a pre-determined pay scale for a winning hand is shown in Table III.

TABLE III

Pre-determined Pay Scale

| Winning hand | Payout |
|---|---|
| Straight Flush | 40-1 |
| Three of a kind | 30-1 |
| Straight | 6-1 |
| Flush | 3-1 |
| Pair | 1-1 |
| High Card | 1-1 |

5. If the player has the higher poker hand, then the ante and bet will both pay even money.
6. If the dealer has the higher poker hand, then the ante and bet will both lose.
7. If the player and dealer hands tie, then the ante and bet will be returned to the player.
8. If the player made the ante bet and has a straight or higher, then the player will receive an ante bonus, regardless of the value of the dealer's hand.

An example of a pre-determined pay scale for a pairs plus bonus hand is shown in Table IV.

TABLE IV

Pairs Plus Bonus Hand Pre-determined Pay Scale

| Ante Bonus | Payout |
|---|---|
| Straight Flush | 4-1 |
| Three of a kind | 3-1 |
| Straight | 1-1 |

9. The pair plus bet will pay entirely based on the poker value of the player's hand and is not subject to the dealer qualifying or the player making a play bet.

Any or all of this game may be played with an actual dealer or with a computerized gaming console with a video screen such as a CRT or a flat screen display such as plasma, LCD, OLED, or LED. The game may be played on site at a legal game casino, in a non-gambling mode on-line over the internet, or off-line on a home computer using a disc such as a compact disc. The game could also be played as a game in gambling or non-gambling mode at a tavern, bar, or the like.

The gaming console may include a computer with a random number generator, and an integrated touch system to facilitate player input. The touch system may be an infrared (IR) touch system, capacitive touch system, resistive touch system, surface acoustical wave touch system, or an inductive touch system, mounted to the cabinet or to the bezel of the screen. A keyboard, cursor, or other input device may be used.

DETAILED DESCRIPTION OF THE DRAWINGS

Figure 1:
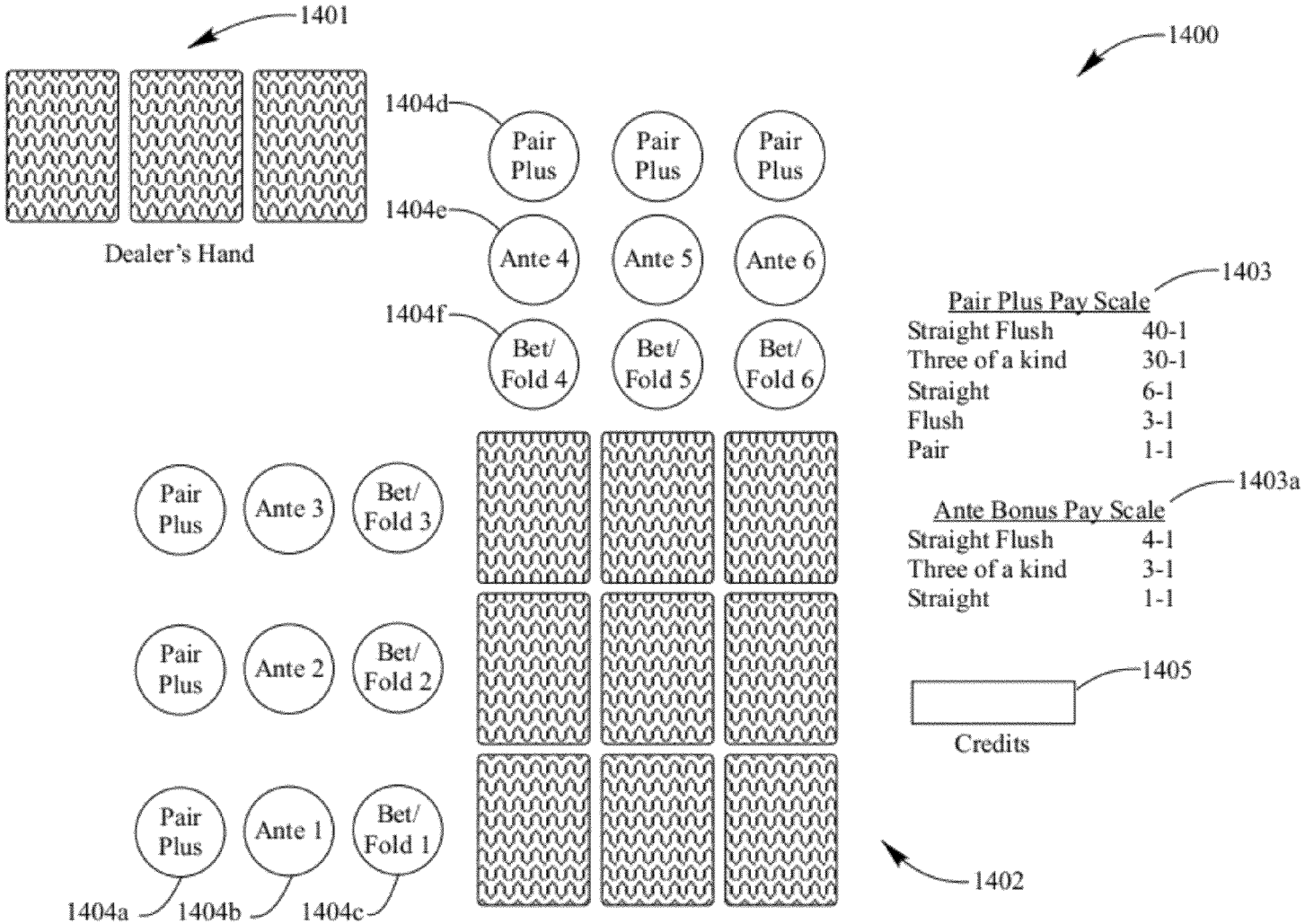
FIG. 1 is an example of the active game area.

FIG. 1 shows active game area 1400, the dealer's hand 1401, the three card by three card grid 1402, a pre-determined pay scale 1403, an ante bonus pay scale 1403*a*, the pair plus wager circle for the first row 1404*a*, the ante wager circle for the first row 1404*b*, the bet or fold circle for the first row 1404*c*, the pair plus wager circle for the first column 1404*d*, the ante wager circle for the first column 1404*e*, the bet or fold circle for the first column 1404*f*, and the credit meter 1405.

Figure 1A:
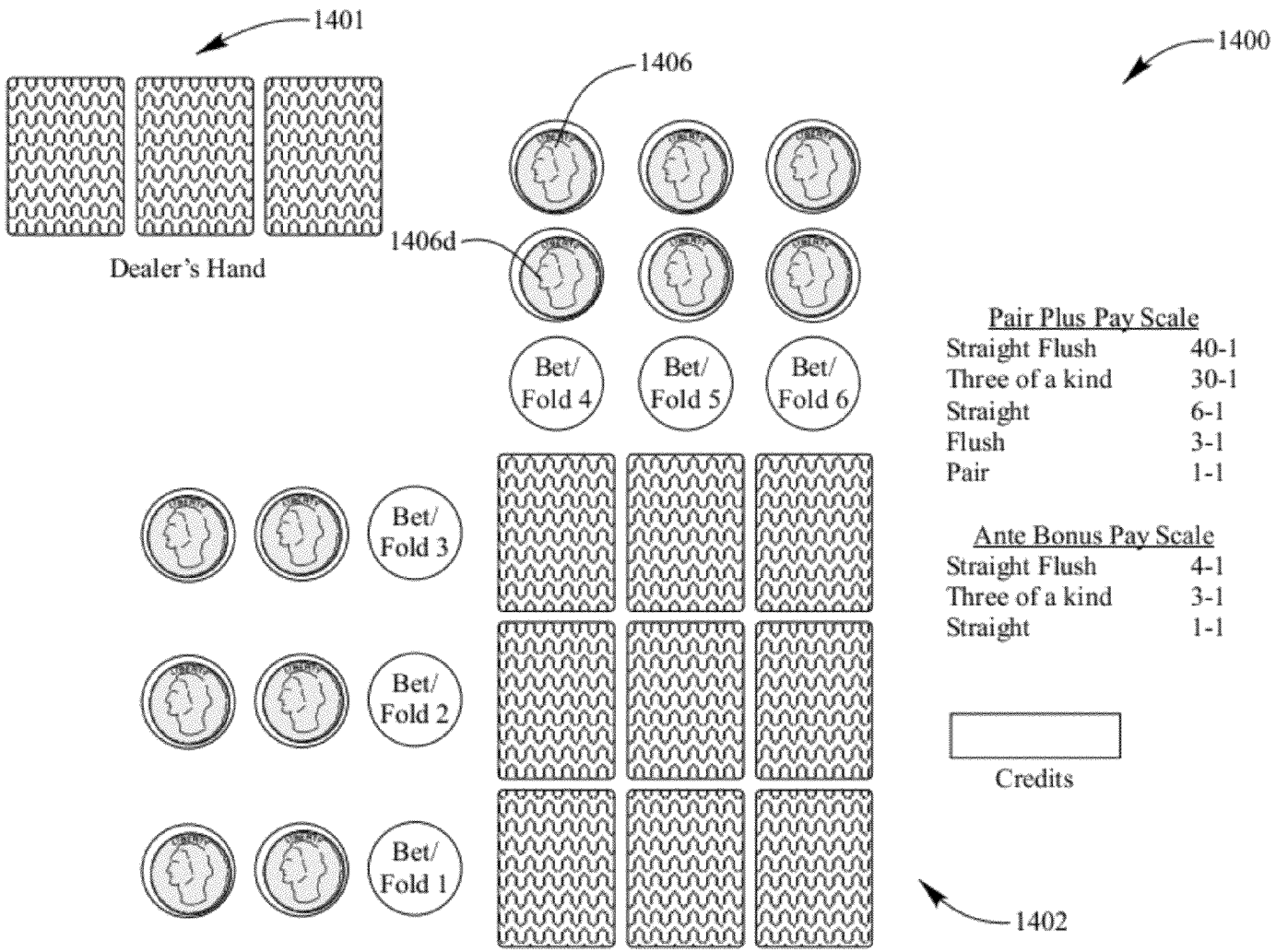
FIG. 1A shows an example of an ante and a pair plus wager.

FIG. 1A shows the active game area 1400 after the ante 1406*d* and pair plus wagers 1406 have been made on all of the rows and columns of possible hands. The dealer's hand 1401 has not yet been revealed and the three card by three card grid 1402 has also not yet been revealed. The player begins the game by placing equal wagers on the ante circle 1406*d* and the optional pair plus circle 1406 for all of the possible hands.

Figure 1B:
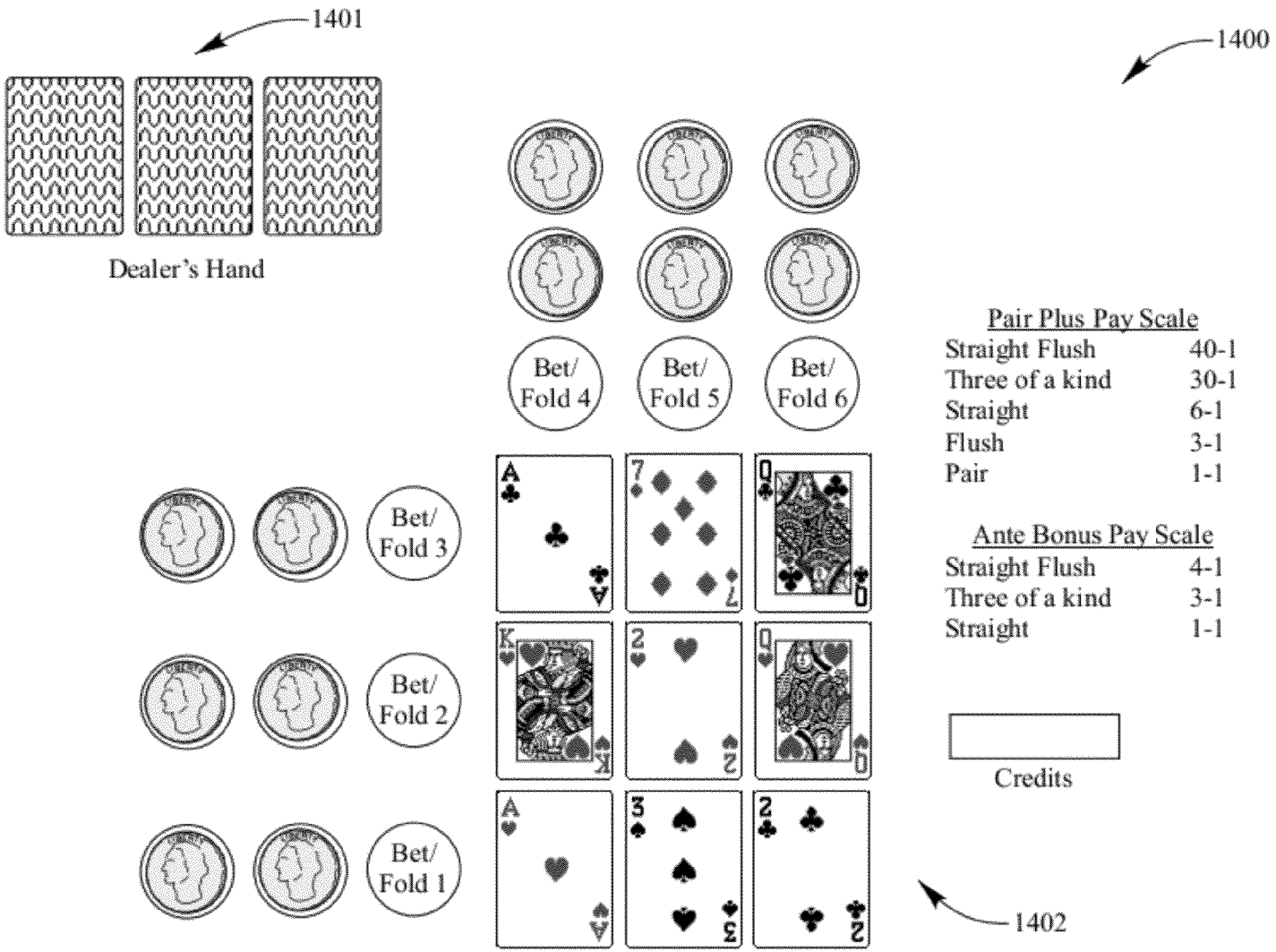
FIG. 1B shows the active game area after the deal.

FIG. 1B shows the active game area 1400 after a computer has used a random number generator to select cards for the player and displayed them face up in a three card by three card grid 1402 giving the player a total of six possible hands to play. The computer also uses the random number generator to select three cards for the dealer and displays them face down 1401.

The player must decide which hands will be folded and which will receive an additional bet. If the player folds a hand, by not placing an additional equal bet on it, then the ante is surrendered. If the player places an additional bet, it must be equal to the ante.

Figure 1C:
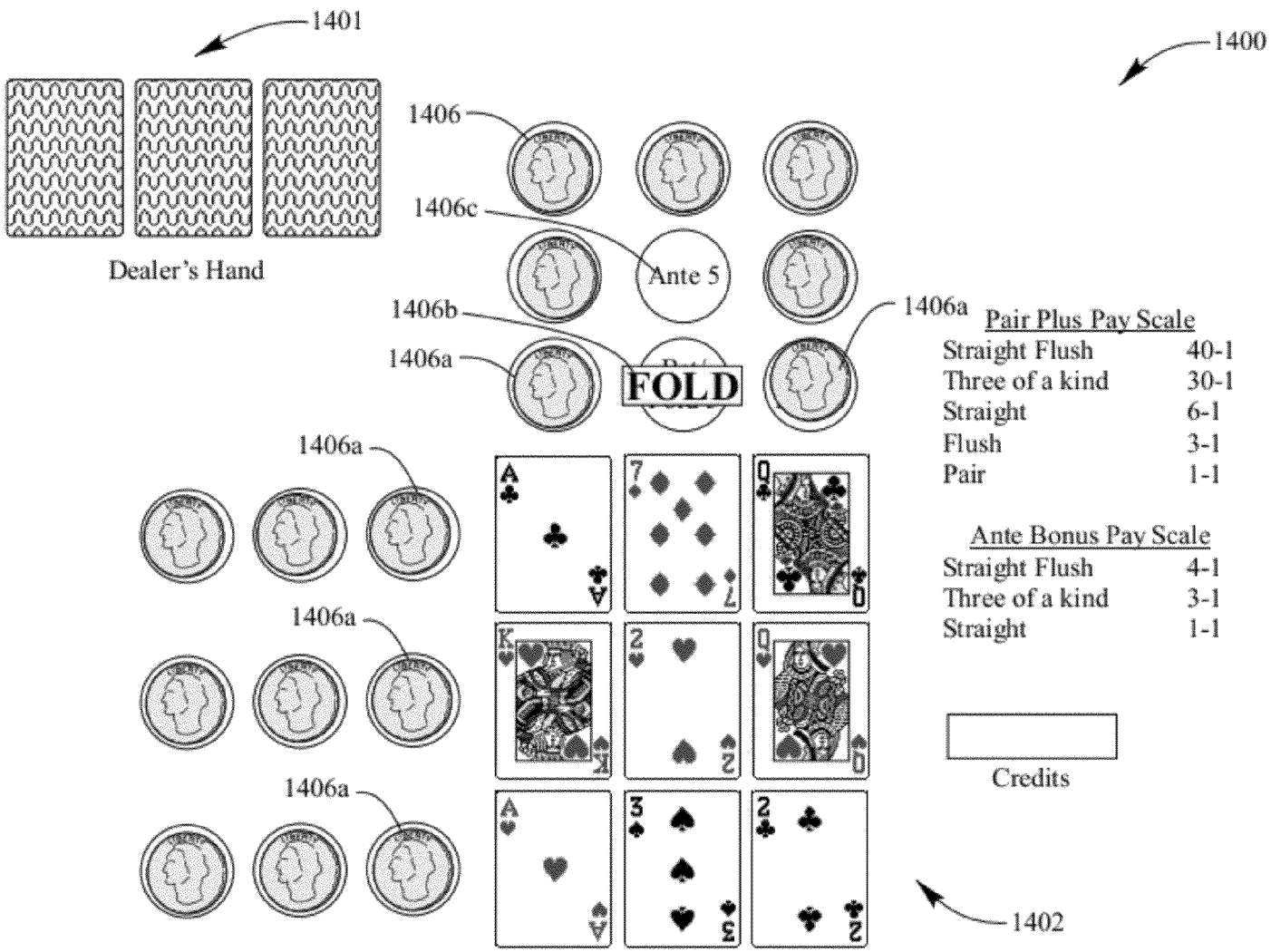
FIG. 1C shows a sample game being played after additional wagers and folding of a hand.

FIG. 1C shows the active game area 1400 after the player has selected which hands to fold 1406*b* and which hands to place an additional bet upon 1406*a*. The player has lost his ante bet 1406*c* for the hand in the second column.

Figure 1D:
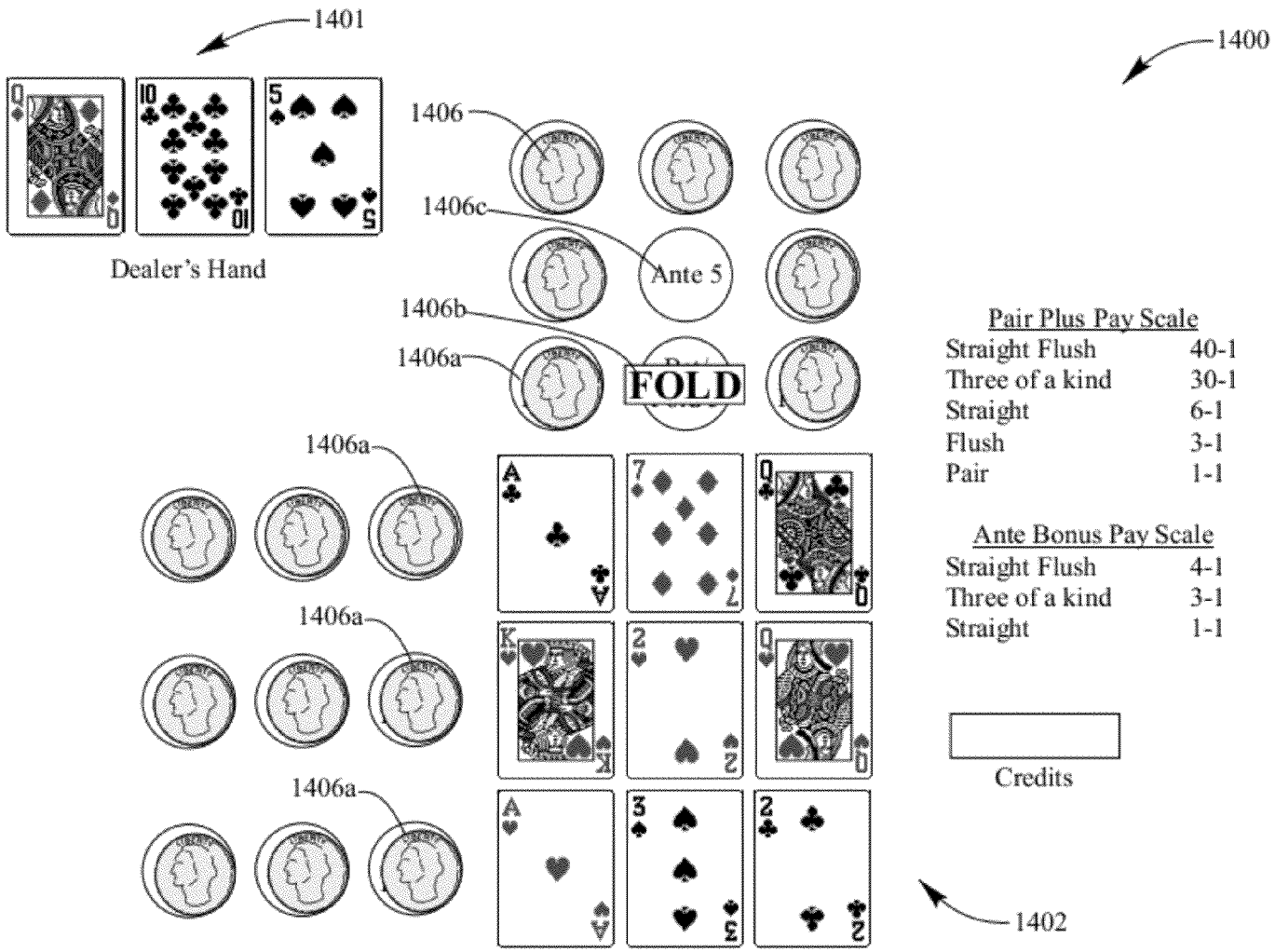
FIG. 1D shows the sample game after a dealers hand is dealt.

FIG. 1D shows the active game area 1400 after the dealer's hand 1401 has been revealed to the player. The dealer has at least a queen and the hand qualifies to be compared to the hands that the player has remaining 1402.

Figure 1E:
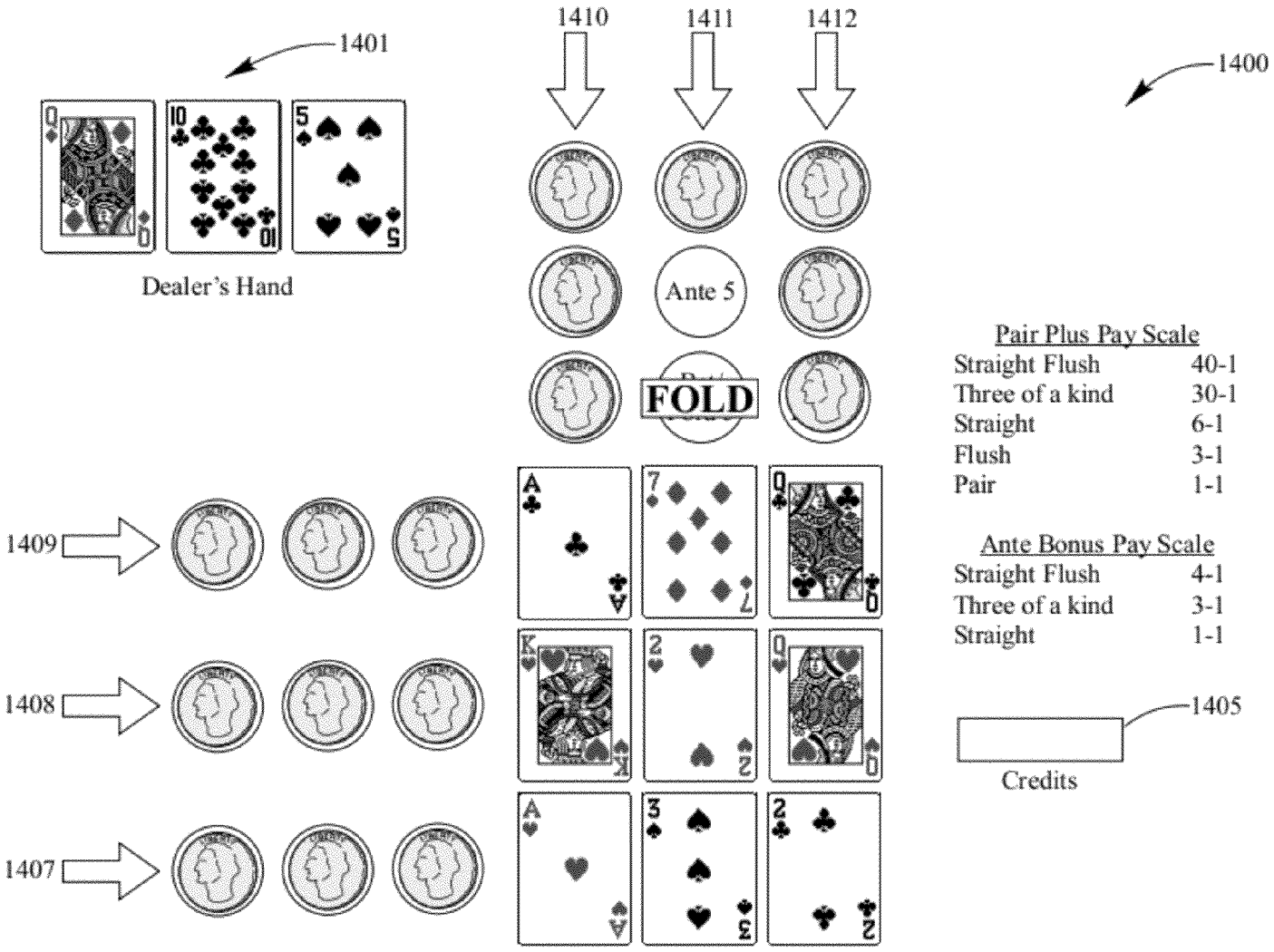
FIG. 1E shows the sample hand after the dealer's hand has been revealed.

FIG. 1E shows the active game are 1400 each row and column are compared to the dealer's hand 1401. The dealer's hand 1401 only has a high card (queen of diamonds). Row one 1407 is compared to the dealer's hand 1401 and the player has a straight, winning the ante and the bet.

Row two 1408 is compared to the dealer's hand 1401 and the player has a flush, winning the ante and the bet. Row three 1409 is compared to the dealer's hand 1401 and the player has high cards, winning the ante and the bet. Column one 1410 is compared to the dealer's hand 1401 and the player has high cards (ace of clubs and queen of clubs), winning the ante and the bet. Column two 1411 was folded, and the player loses the ante and the bet. Column three 1411 is compared to the dealer's hand 1401 and the player has a pair of queens, winning the ante and the bet.

After each row and column is analyzed the computer adds the appropriate amount of money to the credit meter 1405.

Figure 1F:
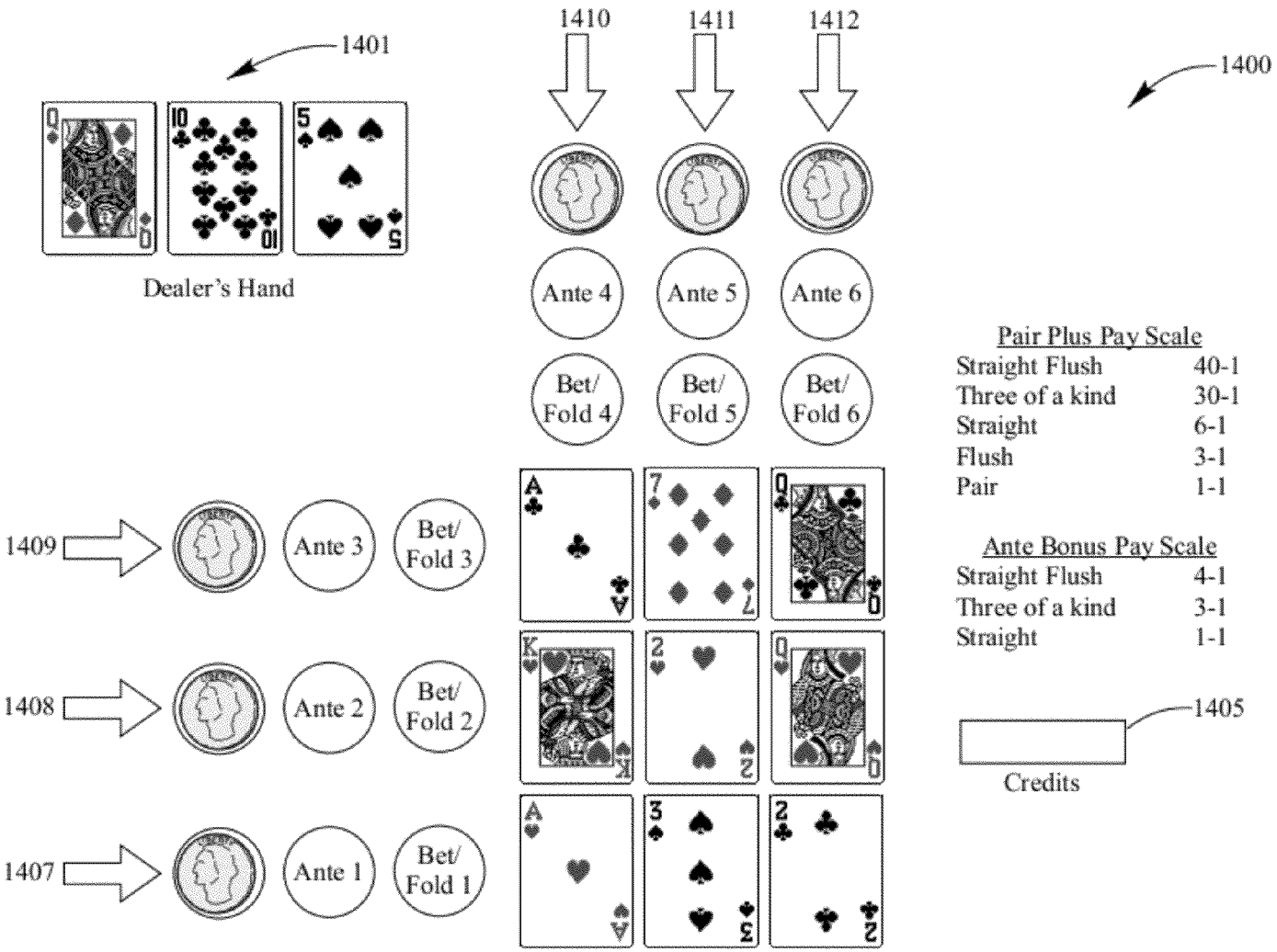
FIG. 1F shows the comparison of the dealer's hand to the player's hands.

FIG. 1F shows the active game area 1400 with the predetermined pair plus payouts as follows: row one 1407, wins 6 to 1 with a straight; row two 1408, wins 3 to 1 with a flush; row three 1409, loses since the hand only has a high card an ace of clubs; column one 1410, wins 1 to 1 with a pair of aces; column two 1411, loses with only a high card a seven of diamonds; column three 1412, wins 1 to 1 with a pair of queens. The computer only analyzes these hands according to standard three card poker rules, and does not compare the hands to the dealer's hand 1401. The payouts are calculated and the computer adds the appropriate amount to the credit meter 1405.

Figure 2:
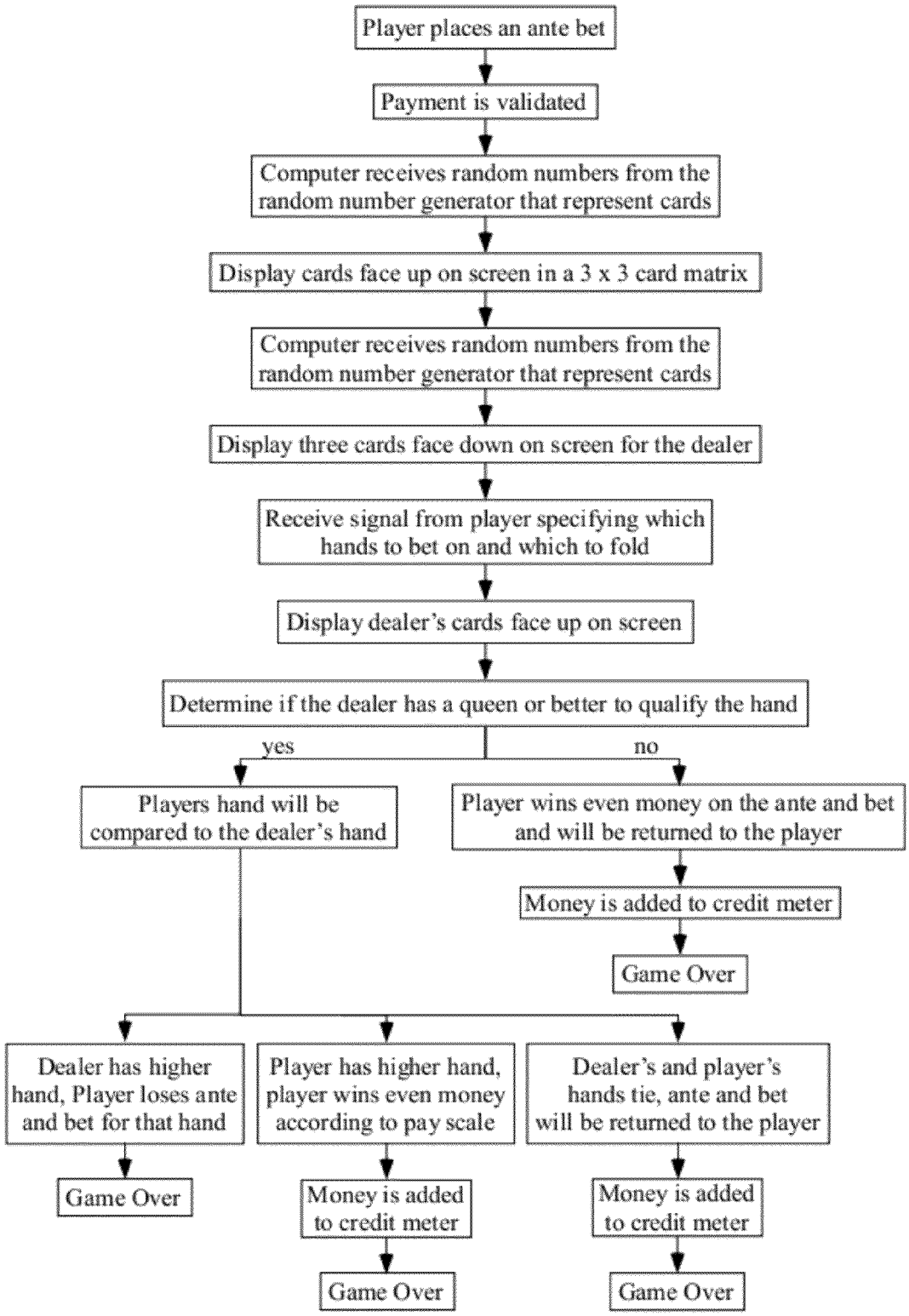
FIG. 2 shows a block diagram of the game with only an ante bet.

FIG. 2 shows a block diagram of a typical game of three card poker as described in the present invention. In this embodiment, the player chooses not to play the pairs plus option.

The player places a bet, which is validated by the computer or dealer. The computer sends a signal to a random number generator. The random number generator sends nine numbers which represent cards to the computer. The computer displays the cards face up in a three card by three card grid. The computer sends another signal to a random number generator. The random number generator sends three numbers which represent cards to the computer. The computer displays the cards face down in a three card row representing the dealer's three card poker hand. The player chooses which hands to bet on, by placing a bet on the hand, and which to fold. The computer displays the dealer's hand face up, and determines if the dealer's hand has a queen or better to qualify the hand.

If the dealer's hand has a queen or better then the player hands will be compared to the dealer's hand. If the dealer has a higher hand, then the player loses the ante bet and the bet for the hand, and the game is over.

If the dealer's hand has a queen or better then the player hands will be compared to the dealer's hand. If the player has a higher hand then the player wins even money according to a pre-determined pay scale, money is added to a credit meter and the game is over.

If the dealer's hand has a queen or better then the player hands will be compared to the dealer's hand. If the dealer's hand and the player's hand tie then the ante and the bet are returned to the player, money is added to a credit meter and the game is over.

If the dealer's hand does not have a queen or better then the player wins even money on the ante and the bet. The ante and the bet are returned to the player, money is added to a credit meter and the game is over.

Figure 3:
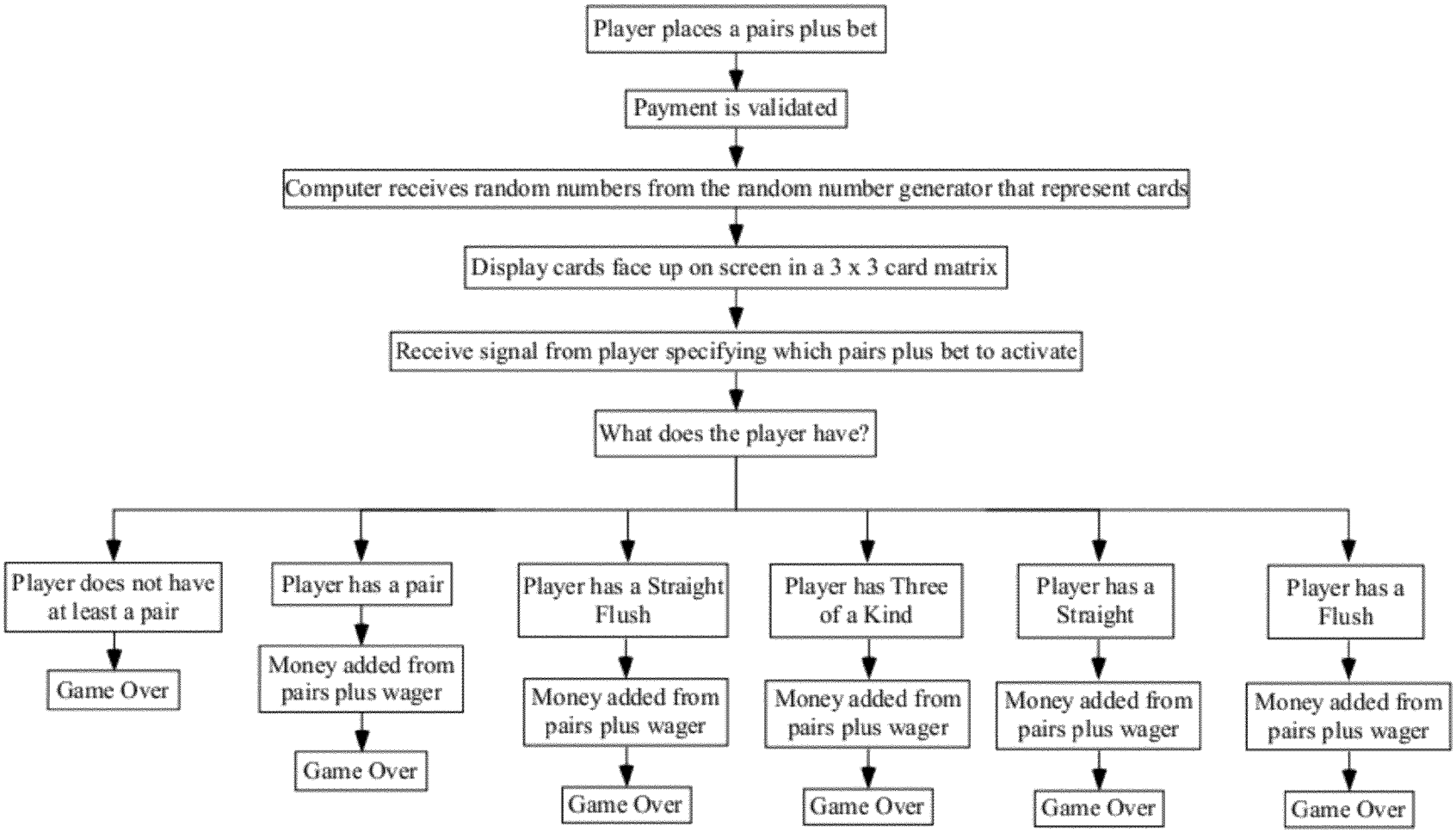
FIG. 3 shows a block diagram of the game with only a pairs plus bet.

FIG. 3 shows a block diagram of a typical game of three card poker as described in the present invention, where only the pairs plus option is played.

The player places a pairs plus wager, which is validated by the computer or dealer. The computer sends a signal to a random number generator. The random number generator sends nine numbers which represent cards to the computer. The computer displays the cards face up in a three card by three card grid. The player chooses which pairs plus bet to activate.

The computer determines the proper payout for each of the hands that had a bet placed upon them, and pays accordingly.

Figure 4:
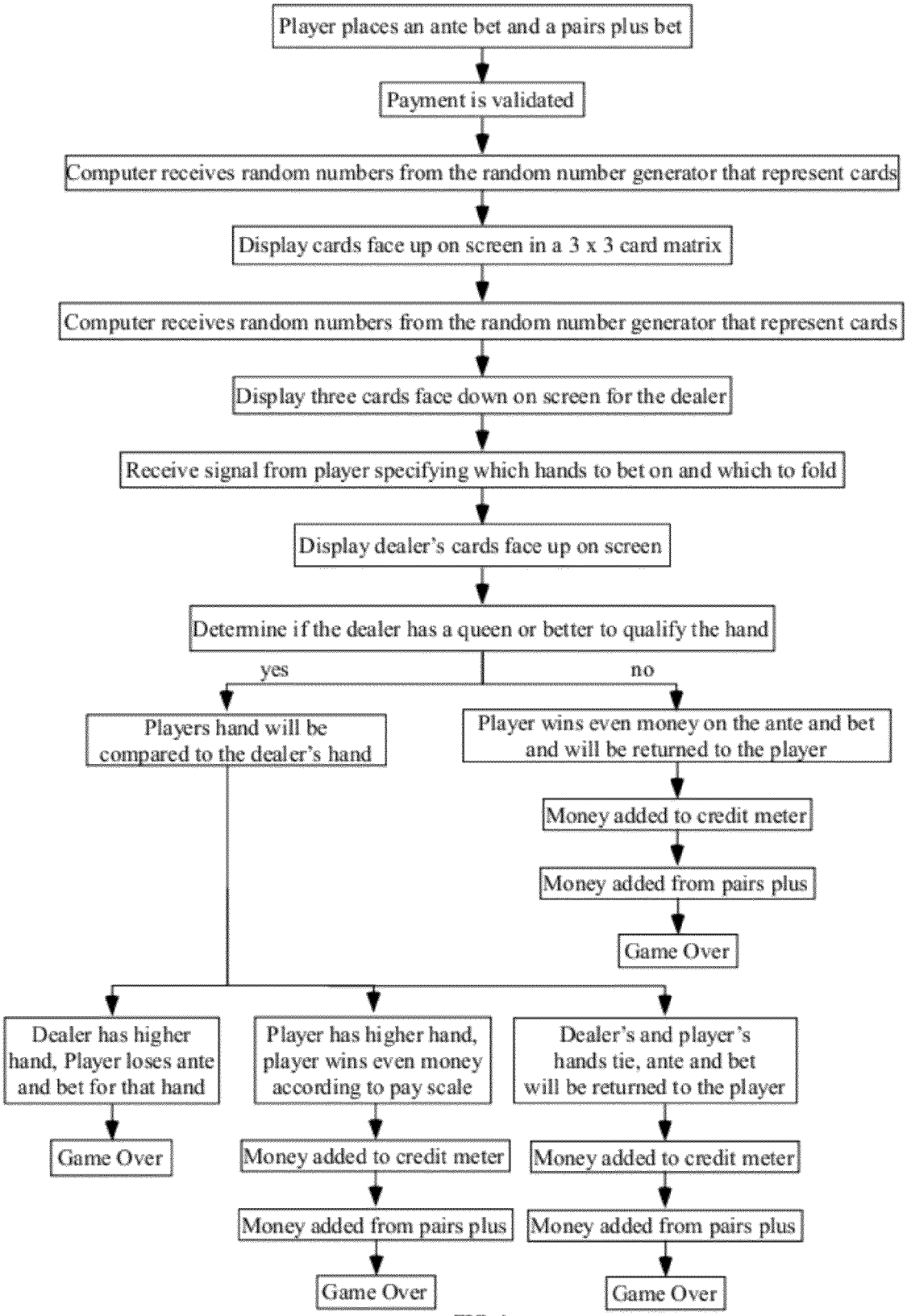
FIG. 4 shows a block diagram of the game with an ante bet and a pairs plus bet.

FIG. 4 shows a block diagram of a typical game of three card poker as described in the present invention. In this embodiment, the player chooses to play the pairs plus option.

The player places a bet, and a pairs plus wager, which is validated by the computer or dealer. The computer sends a signal to a random number generator. The random number generator sends nine numbers which represent cards to the computer. The computer displays the cards face up in a three card by three card grid. The computer sends another signal to a random number generator. The random number generator sends three numbers which represent cards to the computer. The computer displays the cards face down in a three card row representing the dealer's three card poker hand. The player chooses which hands to bet on, by placing a bet on the hand and which to fold. The computer displays the dealer's hand face up, and determines if the dealer's hand has a queen or better to qualify the hand.

If the dealer's hand has a queen or better then the player hands will be compared to the dealer's hand. If the dealer has a higher hand then the player loses the ante bet and the bet for the hand and the game is over.

If the dealer's hand has a queen or better then the player hands will be compared to the dealer's hand. If the player has a higher hand then the player wins even money according to a pre-determined pay scale, money is added to a credit meter, if the hand has a Straight Flush, Three of a kind, or a Straight, the pairs plus bonus is paid accordingly, and the game is over.

If the dealer's hand has a queen or better then the player hands will be compared to the dealer's hand. If the dealer's hand and the player's hand tie then the ante and the bet are returned to the player, money is added to a credit meter and the game is over.

If the dealer's hand does not have a queen or better then the player wins even money on the ante and the bet. The ante and the bet are returned to the player, money is added to a credit meter and the game is over.

Figure 5:
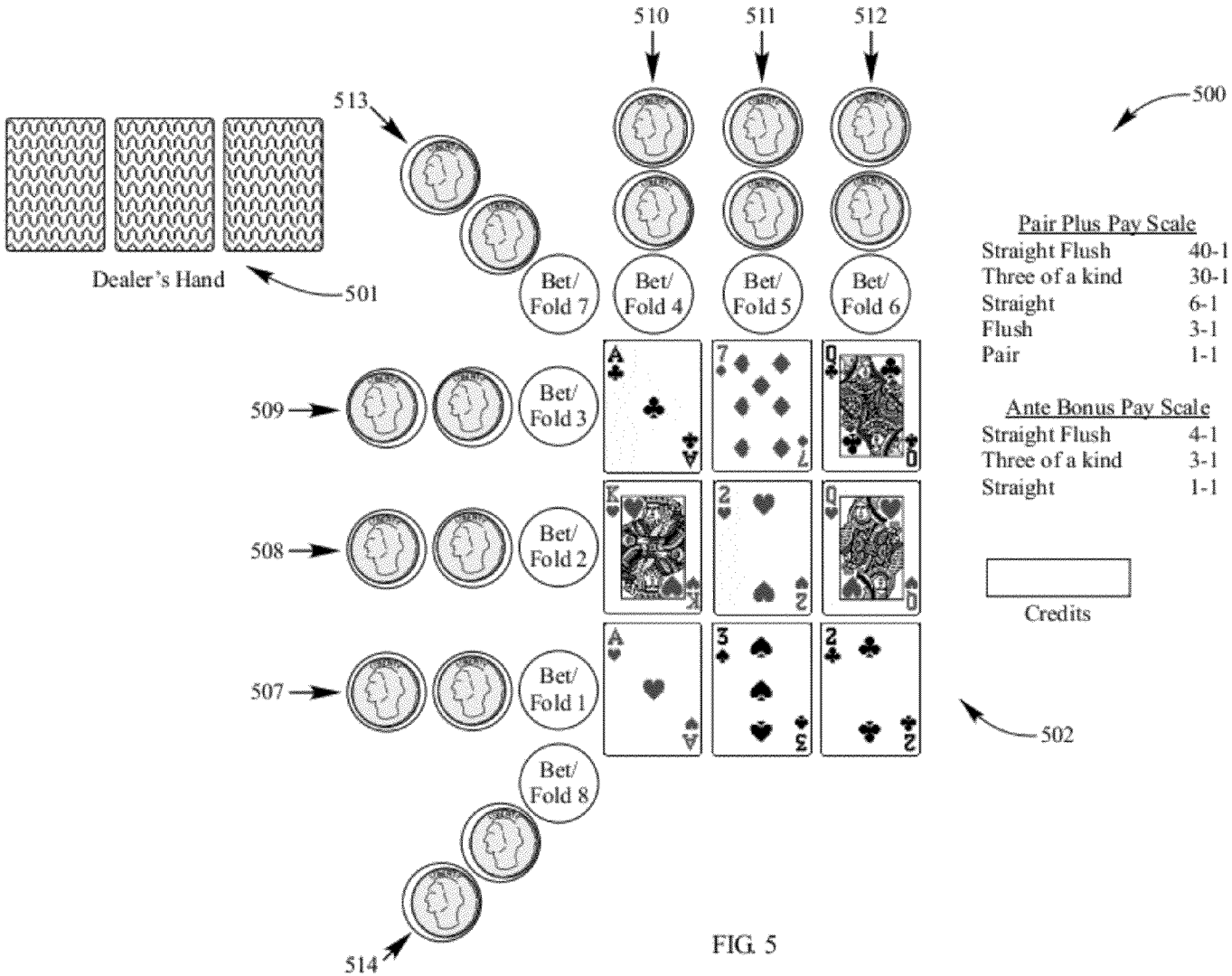
FIG. 5 provides two diagonal lines in the three by three grid to allow a player to play a total of 8 hands.

FIG. 5 provides two diagonal lines in the three by three grid to allow a player to play a total of 8 hands. FIG. 5 shows active game area 500 after the computer has used a random number generator to select cards for the player and displayed them face up in a three by three card grid 502. Two additional player hands are created in this embodiment to provide the player with a total of eight possible hands to play. These new hands are diagonal hand 513 and 514. The computer also uses the random number generator to select three cards for the dealer and displays them face down 501. The player must decide which hands out of the eight possible hands will be folded and which will receive an additional bet. If the player folds a hand by not placing an additional equal bet on it, the ante is surrendered. If the player places an additional bet, it must be equal to the ante.

Figure 6:
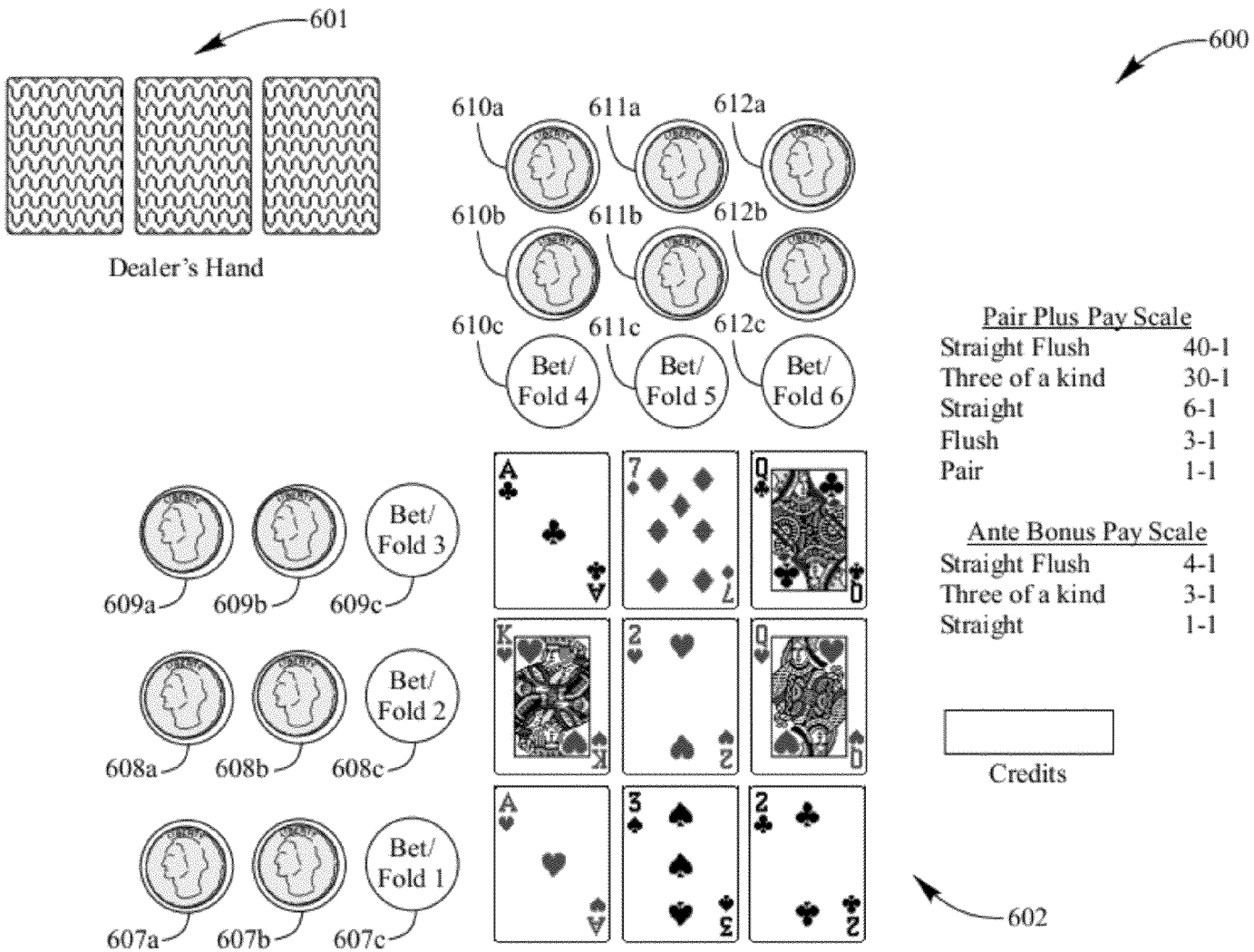
FIG. 6 allows the player to take on the role of the dealer and play against the computer's six hands.

FIG. 6 allows the player to take on the role of the dealer and play against the computer's six hands. FIG. 6 shows the active game area 600, the player taking on the role of the dealer by using the three cards 601 as his hand, and the computer playing each of the six hands in the three by three card grid 602. The computer has chosen to activate all six hands prior to the cards being dealt into the three by three card grid and places an equal bet on both the ante circles 607*b*, 608*b*, 609*b*, 610*b*, 611*b*, 612*b* and pair plus bet circles 607*a*, 608*a*, 609*a*, 610*a*, 611*a*, 612*a*. According to a predetermined decision based on a preprogrammed set of rules within the central processing unit (CPU) and memory unit, the computer chooses which of the six hands it will place bets on and which hands it will fold. Once the computer selects which hands to bet or fold, the player, now acting as the dealer in this embodiment, will reveal the three cards 601 that the random number generator has dealt into the dealer's three card hand 601. Each of the computer's hands will be compared to a predetermined pay scale and to the player's hand to award the proper payouts. The player acting as the dealer will pay out the wins for each winning computer hand and will collect from losing or folded hands.

Figure 7:
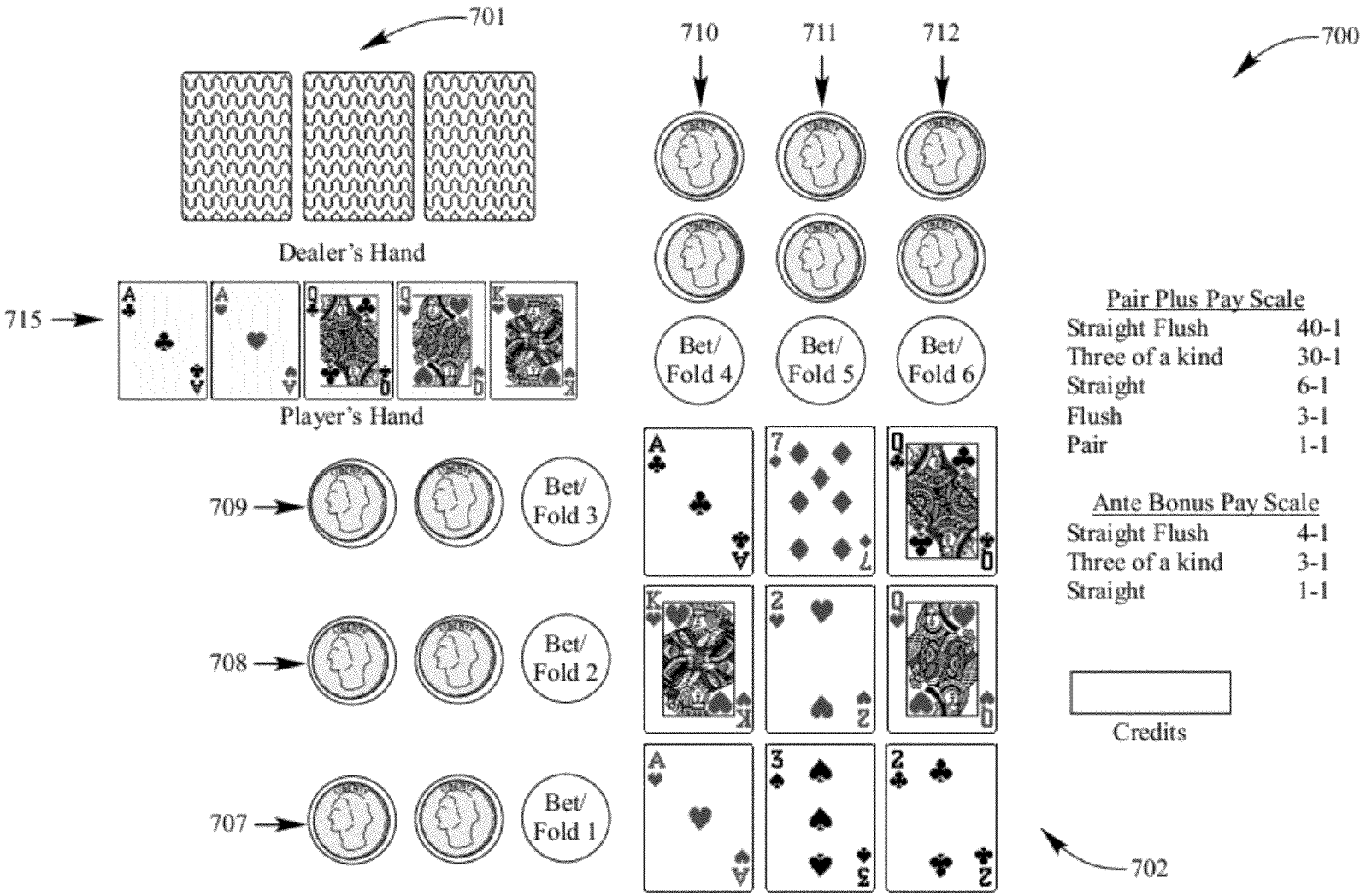
FIG. 7 allows the player to create his best five card poker hand from the three by three card grid.

FIG. 7 allows the player to create his best five card poker hand from the three by three card grid. FIG. 7 shows the active game area 700, the embodiment from the original game allowing the best five card poker hand 715 to be created from the three by three card grid 702. This hand as illustrated is a pair of aces, a pair of queens, and a king. In this particular hand 715, the player was able to create a hand consisting of: the ace of hearts (row 707, column 710), ace of clubs (row 709, column 710), queen of hearts (row 708, column 712), queen of clubs (row 709, column 712), and king of hearts (row 708, column 710) which will be compared to a predetermined pay scale and a set amount paid out prior to continuing on to the three card poker game in the three by three card grid 702. The three card game continues after the five card hand is completed.

Figure 8:
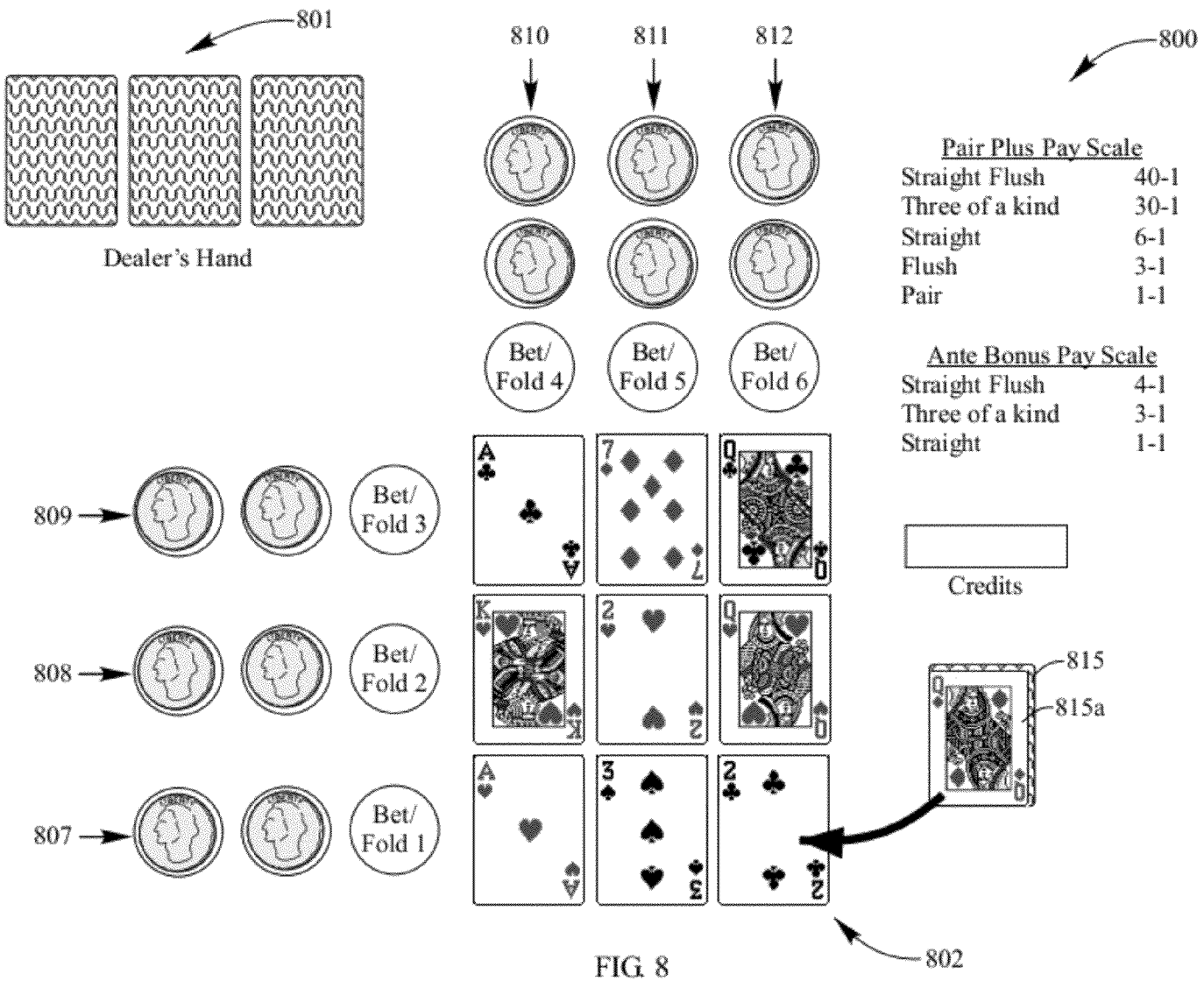
FIG. 8 allows the player to draw the next card in the deck to place on the three by three grid to improve the hands prior to placing bets on each hand.

FIG. 8 allows the player to draw the next card in the deck to place on the three by three grid to improve the hands prior to placing bets on each hand. FIG. 8 shows the active game area 800 and the remaining deck of cards 815 with the next card, the queen of diamonds, turned face up 815*a*. In this embodiment, the player has the opportunity to place the queen of diamonds in any of the nine card positions in the three by three card grid 802. In this particular case, the player decides to place the queen of diamonds in the position of the two of clubs (row 807, column 812), thus removing the two of clubs from the three by three card grid, and positioning the queen of diamonds in the position that was occupied by the two of clubs. Placing the card into the three by three card grid can help improve any, all, or none of the six hands in the grid 802. In this illustration there results three of a kind.

Figure 9:
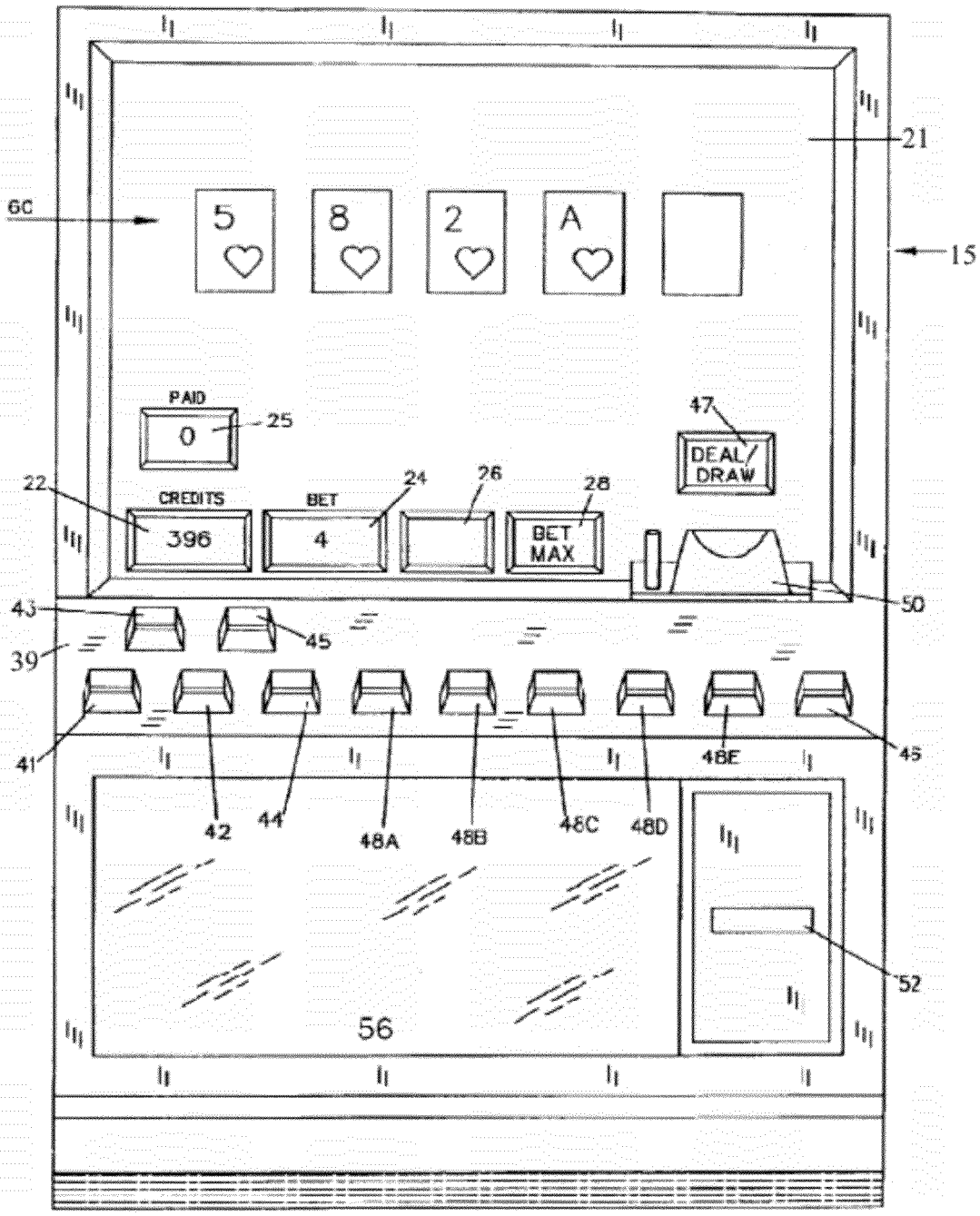
FIG. 9 shows a typical electronic video gaming machine.

FIG. 9 shows a typical electronic video gaming machine 15 that is configured to provide a player apparatus for a poker game such as the method and system of the present invention. The electronic video gaming machine 15 includes a conventional coin acceptor 50 into which the player can insert coins or gaming tokens and a bill acceptor 52 mounted to the gaming machine 15 and into which the player can insert paper currency or a ticket-in ticket-out (TITO). The use of coins, tokens, paper currency or TITO, is one mechanism by which a player may wager on the poker hands the player wishes to play. Also in the electronic video gaming machine 15, a credit meter display 22 is provided to show the amount of credits that the player has accrued on the gaming machine 15, either by inserting coins, tokens, paper currency, TITO, or from winning plays achieved by the player. Whenever the player makes a wager, the amount of the wager is subtracted from the credit meter display 22. Whenever the player achieves a winning play during the play of the game, the amount of the winning play is added to the credit meter display 22.

A conventional payout hopper is also located on the interior of the gaming machine and is used to dispense coins or tokens to the player into a payout tray 56 when the player wishes to collect any winning amounts the player has accrued. Other suitable and conventional payout mechanisms can be used, such as a ticket printer (TITO) or other cashless payout devices.

The gaming machine 15 also includes a video screen display 21 of any suitable size or type upon which representations of playing cards are displayed. In one embodiment, one or more hands can be displayed on the video screen display 21 at the same time. As illustrated in FIG. 9, a first hand is shown at location 60. Each hand would preferably have five card locations typically from left to right in a horizontal row, although other manners of displaying multiple hands including stacks of cards can be used. In this invention, the three by three grid, the dealer's hand, and the five card hand (from the grid) can be shown on the display. The video screen display 21 also contains a location at which the amount wagered on each hand is shown, for example, "Bet" 24. In this illustration, the player has bet 4 credits.

A button panel 39 is also provided on the gaming machine 15 with buttons mounted on the button panel 39 to be used by the player to control the operation of the gaming machine 15. Any suitable number or configuration of the buttons on the button panel can be used and, alternatively, conventional touch screen technology can be used for any or all of the buttons mounted on the button panel.

A typical button arrangement is shown on the button panel 39 in FIG. 9. A BET ONE button 42 is provided to allow the player to wager one credit at a time. A BET MAX button 44 is provided to allow the player to wager the maximum amount of credits permitted by the configuration of the gaming machine 15. Any number of credits can be set as the minimum or maximum amount that it is possible to wager on each hand. Typically, five credits may be the maximum number of credits for any particular hand. Alternatively, a BET ONE location 26 and a BET MAX location 28 can be provided on the video screen 21 to allow the player to wager by using conventional touch screen technology.

A conventional DEAL/DRAW button 46 is also provided on the button panel 39 which is used by the player to activate the initial deal of the cards at the deal stage of the method of play or the dealing of replacement cards at the draw stage of the method of play as is appropriate. Similarly, a DEAL/DRAW location 47 can be provided on the video screen 21 to allow the player to select either the deal step or the draw step by using conventional touch screen technology. In this illustration, the button panel 39 is shown with five "CARD" buttons 48A, 48B, 48C, 48D and 48E associated with each horizontal card location on the video screen display: card button 48A is associated with the left most card location, card button 48B is associated with the second from the left card location, card button 48C is associated with the middle card location, card button 48D is associated with the second from the right card location and card button 48E is associated with the right most card location. Each card button is preferably aligned below the card locations so that the player can easily associate the appropriate card button with the appropriate card location.

The method of play of the various versions of the present invention will now be described. After the player has inserted an appropriate amount of coins, tokens, paper currency, or TITO to add a sufficient amount of credits on the credit display meter 22, the player makes his initial wager. The player may press the BET ONE button 42 one or more times to bet in single increments or the player may merely press the BET MAX button 44 and the maximum number of credits are applied, for example, five credits would be wagered. The player can also use the touch screen locations to make his wager as described above.

To play the poker game, the player establishes a pool of credits, sets the wager, deals the cards, chooses which cards to hold and discard, draws replacement cards, and collects credits for winning card combinations, with enhancements.

Buttons

In one embodiment, a set of buttons are mounted on the button panel 39 and are used by the player to control the functions of the poker game: Bet One 42, Bet Max 44, Deal/Draw 46, Help 43, Pay Table 45, and Cash Out 41. Any or all of these control buttons may be displayed on the video display 21 and/or buttons electronically connected to the gaming device. If necessary, any number of buttons may be added to further facilitate control of the game, such as Hold buttons to "hold" the cards displayed on the video.

Meters

In one embodiment, meters are shown on the video display screen to display the salient information for the game: Credits meter 22, Bet meter 24, and Paid meter 25. The Credits meter 22 displays the total number credits remaining in the credit pool; the Bet meter 24 displays the amount wagered on the current, previous, and/or upcoming poker hand and is associated with the Bet One 42 and Bet Max 44 buttons; and the Paid meter 25 displays the amount of credits won on the current or previous poker hand.

Credit Pool

In one embodiment, the player deposits coins, tokens, paper currency, TITO, credit cards, debit cards, or other forms of physical and/or electronic currency into the coin acceptor slot 50 or a paper currency bill acceptor 52 to establish a pool of credits. The amount of this common pool of credits is displayed to the player on the Credit meter 22. The pool of credits increases and decreases according to the player's wins or losses and may be supplemented, if necessary, by the player by additional deposits of coins, tokens, paper currency, TITO, credit cards, debit cards, or other forms of physical and/or electronic currency.

Set the Wager

In one embodiment, the player sets the value of the wager by using the Bet One 42 and Bet Max 44 buttons. The bet may range between one credit and N-credits, with N equal to a predetermined maximum or set by the current value of the credit pool. The typical video poker gaming machine uses a five credit maximum wager.

Deck of Cards

In one embodiment, each card dealt is selected from one or more suitable decks of cards such as one or more fifty-two card traditional decks (i.e. the traditional four suits of Spades, Hearts, Diamonds, Clubs, with thirteen ranks in each suit of two, three, four, five, six, seven, eight, nine, ten, Jack, Queen, King and Ace) plus bonus cards that may be added before or after the deal or the draw. Custom decks may also be used.

Deal of Cards

In one embodiment, the player causes the machine 15 to deal the cards by pressing the Deal button 46. Once the Deal button 46 is pressed, the wager is final and non-refundable. For each deal, as shown with a five card hand, the machine 15 randomly displays five cards face-up in the five card positions 1, 2, 3, 4, 5. In a single standard deck embodiment, a displayed card is removed from the deck and may not be dealt again during that game. Typically, only the remaining non-dealt cards in the deck are used to replace a dealt card.

Hold and Discard

In some embodiments, the player may select cards to hold and cards to discard using the buttons on the machine 15 or touching the cards on the video display 21 (i.e. pressing a button or touching a card will "hold" the card) Alternatively, the machine 15 may automatically select cards to hold and/or discard and then allow the player to override the selections by using the buttons or touching the display screen 21. This may be useful in a training mode.

Winning Card Combinations

In one embodiment, the player is paid for predetermined winning combinations of cards that appear in each final hand. Each winning combination pays the amount indicated on a pre-determined pay scale times the total amount wagered on that hand.

SUMMARY

The foregoing description of various embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims to be interpreted in accordance with the breadth to which they are fairly, legally, and equitably entitled.

The invention claimed is:

1. In a video game method for playing three card video poker using a computer, a random number generator, and a video display screen wherein the computer receives random numbers representing cards from the random number generator and displays the cards on the video display screen, the improvement which comprises:

randomly generating a single dealer poker hand of three cards with a random number generator;

displaying the dealer hand face down on the video display screen with the computer;

randomly generating a grid of three cards by three cards with the random number generator to form three vertical player poker hands, three horizontal player poker hands, and two diagonal poker hands;

displaying eight player poker hands face up on the video display screen with the computer;

placing a bet or folding each of the eight player hands with a signal to the computer;

displaying the dealer hand face up;

and awarding with the computer a payout for each winning poker hand compared to the dealer poker hand.

2. The video poker game method of claim 1 wherein the three card by three card grid is generated from a standard deck of 52 cards.

3. The video poker game method of claim 1 wherein the three card by three card grid is generated from a multiple deck of cards.

4. The video poker game method of claim 1 wherein the player has the option to select the role of dealer and play against the eight hands in the grid of three by three cards.

5. The video poker game method of claim 1 wherein the player has the option of selecting five cards from the grid of three by three cards to create a poker hand with a payout according to a predetermined scale.

6. The video poker game method of claim 1 wherein the player has the option of drawing a new card and placing it in the three by three card grid as a replacement card for a selected card.

7. In a video game system for playing three card video poker using a computer, a random number generator, and a video display screen wherein the computer receives random numbers representing cards from the random number generator and displays the cards on the video display screen, the improvement which comprises:

randomly generating a single dealer poker hand of three cards with a random number generator;

displaying the dealer hand face down on the video display screen with the computer;

randomly generating a grid of three cards by three cards with the random number generator to form three vertical player poker hands, three horizontal player poker hands, and two diagonal poker hands;

displaying eight player poker hands face up on the video display screen with the computer;

placing a bet or folding each of the eight player hands with a signal to the computer;

displaying the dealer hand face up;

and awarding with the computer a payout for each winning poker hand compared to the dealer poker hand.

8. The video poker game system of claim 7 wherein the three card by three card grid is generated from a standard deck of 52 cards.

9. The video poker game system of claim 7 wherein the three card by three card grid is generated from a multiple deck of cards.

10. The video poker game system of claim 7 wherein the player has the option to select the role of dealer and play against the eight hands in the grid of three by three cards.

11. The video poker game system of claim 7 wherein the player has the option of selecting five cards from the grid of three by three cards to create a poker hand with a payout according to a predetermined scale.

12. The video poker game system of claim 7 wherein the player has the option of drawing a new card and placing it in the three by three card grid as a replacement card for a selected card.

* * * * *